United States Patent [19]

Dillon

[11] Patent Number: 4,901,480

[45] Date of Patent: Feb. 20, 1990

[54] LENS GENERATING TOOL FOR GENERATING A LENS

[75] Inventor: Laurence A. Dillon, Livonia, Mich.

[73] Assignee: CDP Diamond Products, Inc., Livonia, Mich.

[21] Appl. No.: 254,253

[22] Filed: Oct. 6, 1988

[51] Int. Cl.[4] ..... B24D 7/06

[52] U.S. Cl. ..... 51/209 R; 51/266; 407/118; 407/119; 407/7; 407/34; 82/1.11; 82/173; 82/12

[58] Field of Search ..... 51/284 R, 206 R, 206.5, 51/209 R, 204 R, 266, 307, 55, 124 L; 407/7, 34, 118, 119, 33, 40, 42, 41, 53, 62, 61; 82/1 R, 1 C, 36 R, 12, 1.11, 158, 173

[56] References Cited

U.S. PATENT DOCUMENTS

| | | | |
|---|---|---|---|
| 2,958,119 | 11/1960 | Stansfield et al. | 407/40 |
| 3,374,586 | 3/1968 | Stone | 51/209 R |
| 3,405,433 | 10/1968 | Williams | 407/40 |
| 3,685,210 | 8/1972 | Bowen | 51/33 W |
| 3,733,665 | 5/1973 | Spriggs | 407/42 |
| 3,831,236 | 8/1974 | Coburn et al. | 407/53 |
| 4,457,765 | 7/1984 | Wilson | 51/307 |
| 4,743,144 | 5/1988 | Shikata | 407/42 |

FOREIGN PATENT DOCUMENTS

| | | | |
|---|---|---|---|
| 0551173 | 11/1956 | Italy | 407/62 |

OTHER PUBLICATIONS

Coburn Optical Laboratory Supplies, Fall 1988, pp. 1–43, Coburn Optical Industries, Inc., Muskogee, Okla.

*Primary Examiner*—Robert Rose

*Attorney, Agent, or Firm*—Charles W. Chandler

[57] ABSTRACT

A tool for generating a prescription surface in a plastic eyeglass lens. A pair of replaceable, cutting elements are mounted on a tool having a spindle. Each cutting element has a solid polycrystalline diamond material forming a cutting edge for progressively shaving a surface on the backside of the lens as the tool is swing back and forth. The surface so generated need only be polished, without the conventional abrasive finishing steps.

1 Claim, 2 Drawing Sheets

LENS GENERATING TOOL FOR GENERATING A LENS

BACKGROUND OF THE INVENTION

This invention is related to a solid polycrystalline diamond cutting tool, and a method for generating a prescription surface in a plastic lens used in spectacles, and more particularly to a method for generating a surface in a plastic lens blank that eliminates the finishing step required after the conventional lens grinding step.

Plastic lens blanks are conventionally formed in an injection molding process, either of a polycarbonate or a plastic material commonly known as CR-39. Polycarbonate is much tougher than CR-39 and is used where safety is a factor in material selection.

U.S. Pat. No. 3,685,210 which issued Aug. 22, 1972 to Gilbert John Bowen shows a prior art method for generating a surface on a lens.

Most commercial processes employ grinding tools for generating the lens. The steps in the conventional grinding process is as follows:

1. A prescription is delivered to the lens generating lab from the optometrist. The prescription is used to set the generating machine.
2. The front side of a lens blank is coated with a dark blue blocking liquid. When dry, the blocking liquid functions to form a temporary bond with a support block. The drying time for the liquid constitutes the longest step in the generating process.
3. The lens blank is then mounted in a blocking machine. A metal support block is placed on the coated front surface and provides means for supporting the lens during the generating, finishing and polishing steps.
4. The blank with the block is then mounted on the generating machine. The generating machine is a standard machine which has been in use for use for many years. Typically a grinding tool is employed for forming the backside of the lens. The tool is rotated at a high speed while traversing the back side of the lens in a series of passes. Each pass removes a layer of material. However, the amount of material removed during each pass is limited by the nature of the grinding surface. Typically, a grinding tool will remove about 2 millimeters per pass, but not limited to. Since as much as 12 millimeters of material has to be removed, several passes are required. The product of the generating machine is a surface having the curvature of the prescription but which is not a finished surface. There is a considerable amount of wastage because of the nature of the grinding process.
5. The lens then is transferred to the first of two cylinder finishing machines. In the first machine, the lens is finished with a pair of abrasive pads in a vibratory process. Each pad is mounted on a metal lap and vibrated against the lens, with water employed as a coolant for 45 seconds to a minute and half. A second abrasive pad is then used, also employing water.
6. The pads are mounted on the lap by an adhesive substance. When the lens has been finished, the adhesive pad which forms a tight attachment, must then be removed. This is a major time-consuming process. In some large shops, some personnel are assigned primarily for peeling the abrasive pads from the lap.
7. The second finishing machine also employs a metal lap on which a thin felt-like pad is used for polishing the lens. The polishing step uses a slurry with the pad. The final polishing step takes about one to five minutes.

The entire process takes about 18 to 20 minutes and in many cases requires a considerable amount of reworking. The felt-like finishing pad is also mounted by an adhesive on a metal lap and has to be peeled after each lens.

In some cases a rotating cutting tool has been employed, rather than a grinding tool. The cutting tool uses an insert having a generally flat surface with a semi-circular cutting edge, however, only a small portion of the edge is formed of a solid polycrystalline diamond material. The problem is the tool performance deteriorates as the tip becomes chipped or worn. Further, it is difficult to cut some curvatures.

Further, the tool is usually swung in a pivoting motion during each pass. A cutting element having a cutting edge only partially formed of a solid polycrystalline material will only cut the lens material when swung in one direction. It will not cut in a reverse motion which limits the usefulness of the generating machine.

SUMMARY OF THE INVENTION

The broad purpose of the present invention is to provide an improved tool, useful for generating a lens formed either of polycarbonate or CR-39 plastic. The preferred tool improves the method for forming a lens by reducing the finishing steps, reducing scrap lens, and reducing the finishing time. The tool has a pair of solid polycrystalline diamond inserts. The tool has a spindle adapted to be rotated at several thousand RPM such that the cutting elements travel in an annular path of motion.

Each cutting insert has a flat cutting face formed of a continuous layer of solid polycrystalline diamond material. The diamond material, as is well known to those skilled in the art, is formed from a powdered material which is placed in a press with a catalyst binder, and then cut to shape.

Each insert has a U-shaped cutting edge and is backed up by a carbide steel layer.

The two cutting elements or inserts are mounted on the tool on opposite sides of the axis of spindle rotation, and provide a balanced cutting action.

In the preferred method, the lens blank is first attached to a block and then mounted in a conventional lens generating machine. The tool is rotated and swung about an axis so the diamond cutting elements traverse the back surface of the lens. The tool removes up to about 8 millimeters per pass, usually requiring fewer passes than a grinding tool.

The generated surface is remarkable because the lens can be moved directly to the polishing machine, bypassing the time-consuming finishing machines. A velveteen pad, mounted on a lap employs a conventional slurry to polish the lens. In addition, the reworking of some lens, required by the conventional grinding process is virtually eliminated, resulting in considerable time and material savings. Further, the inventive process takes only about 10 to 12 minutes from blocking through polishing, which includes certain savings produced by an improved polishing pad. The improved diamond cutting tool will generate a lens either from polycarbonate or CR-39 lens material.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
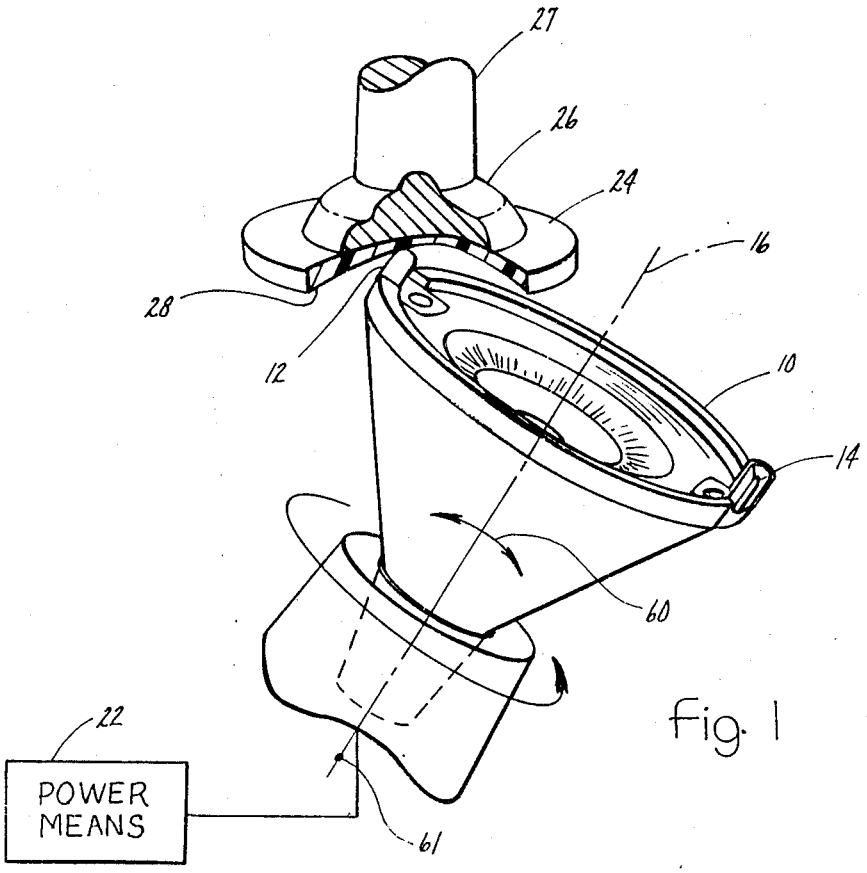
FIG. 1 is a view of a tool having a spindle and a pair of solid crystalline diamond inserts illustrating the preferred embodiment of the invention.

Referring to the drawings, a preferred tool 10 is illustrated in FIG. 1, supporting a pair of identically- shaped cutting elements 12 and 14 for rotation about tool spindle axis 16. The tool is mounted in a conventional lens generating machine having rotary power means 22. Rotary power means 22 rotates the tool in the manner well known to those skilled in the art of lens generating.

A commercially-available CR-39 lens blank 24, is releasably connected to block 26, and mounted in holder 27, in a stationary position, with respect to the tool.

Cutting elements 12 and 14 are adapted to generate a prescription-defined, curved surface 28 on the back side of the lens blank.

Figure 2:
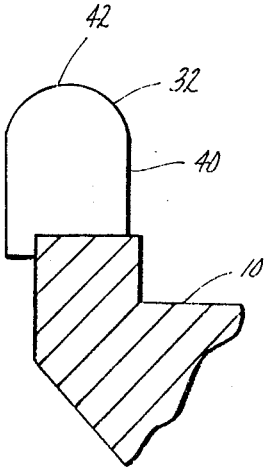
FIG. 2 is an enlarged view of one of the cutting tool inserts.
Figure 4:
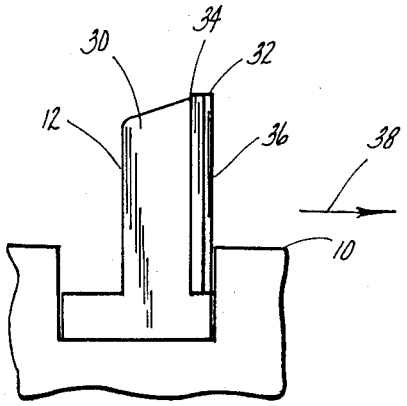
FIG. 4 is an enlarged side view of the preferred diamond cutting element.
Figure 6:
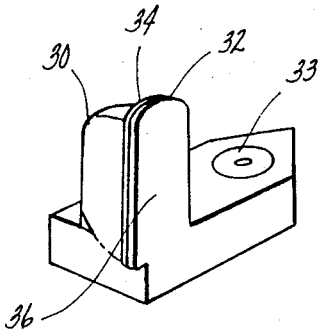
FIG. 6 is a perspective view of a typical diamond cutting tool element.

A typical cutting element 12, illustrated in FIGS. 2, 4 and 6, comprises a carbide steel body 30 connected by fastener 33 to the tool body. The cutting portion of the tool is a solid polycrystalline diamond insert 32, backed-up by a carbide steel layer 34. Insert 32 has a planar surface 36 facing in the direction of arrow 38 which indicates the path of motion of the cutting element about axis 16. Insert 32 is about 0.10 cm thick, and has a cutting edge 40 formed with about a 5 degree bevel. Cutting edge 40 is U-shaped with a semi-circular cutting tip 42. The cutting tip can cut a broad range of curvatures on the lens blank, can be reground and does not have a tendency to chip because the entire face is solid polycrystalline diamond material.

Figure 5:
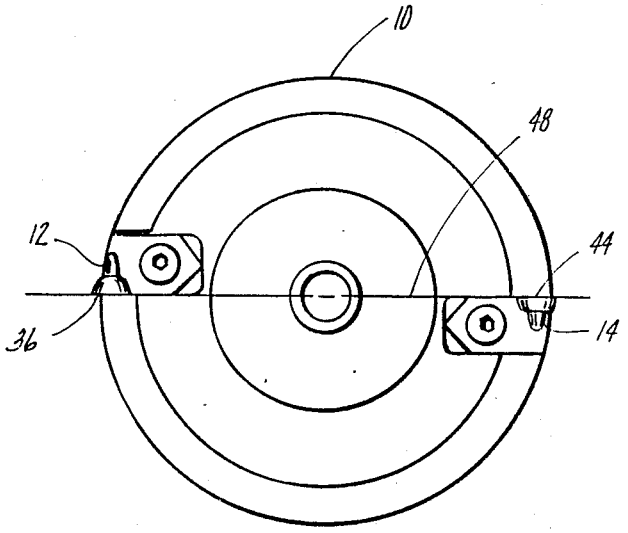
FIG. 5 is a view illustrating two diamond cutting elements on opposite of the tool's axis of rotation.

Referring to FIG. 5, cutting elements 12 and 14 are identical. Each is adapted to be easily replaced on the tool by removing fastener 33. Cutting element 14 has a planar surface 44, corresponding to surface 36 of element 12. The planar surfaces of the two cutting elements are disposed on opposite sides of the tools axis of rotation and is a common plane 48.

Figure 3:
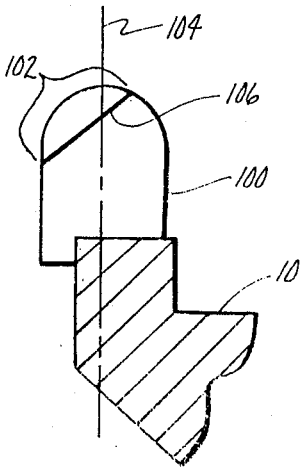
FIG. 3 illustrates the face of a prior art cutting inserts.

FIG. 3 illustrates an earlier cutting element 100 having a U-shaped configuration. However, the cutting edge 102 is formed with an arc less than 180 degrees and is off set from the centerline of symmetry 104 of the cutting element. Only the area bounded by edge 102 and chord 106 was formed of a solid crystalline diamond material. This cutting element had limited practical use because when the tool is swung in a pass to shave the lens material, the cutting element is only useful for cutting in a single direction, but not in the reverse direction.

Referring to FIG. 1, the two cutting elements are mounted on the tool which is then rotated about axis 16. The tool is swung in an arc 60 about a pivot point 61 so that initially, cutting element 12 engages the lens and progressively shaves the back surface of the blank during a portion of each tool rotation. As element 12 traverses the back surface of the blank, element 14 provides a follow-up cutting stroke. When the tool has been swung in a full pass, it is then swung in the opposite direction so that both elements use different portions of their respective cutting edges to shave the lens material.

The two tips provide a balanced cutting means. When the lens surface has been generated by the two cutting elements, the lens is then immediately ready for polishing.

In addition, the preferred tool eliminates the use of expensive intermediate finishing equipment, and is useful for cutting both polycarbonate and CR-39 lens material.

Having described my invention, I claim:

1. In an apparatus for generating a prescription surface in a plastic lens blank the combination comprising:

a tool having a spindle;

means for rotating said tool about an axis of rotation:

a first replaceable cutting element and a second replaceable cutting element mounted on said tool on opposite sides of said axis of rotation, said first cutting element being identical to the second cutting element, each of said respective cutting elements having a respective insert of a solid polycrystalline diamond material and each respective insert forming a planar cutting face facing in the path of rotation of the tool, said inserts of said polycrystalline diamond material each having a semi-circular cutting tip disposed to engage and progressively shave the surface of a plastic lens blank, the improvement in which:

the planar cutting face of the first insert is disposed with the planar cutting face of the second insert in a plane which contains the axis of rotation of the tool, with each semi-circular cutting tip having a centerline of symmetry extending parallel to said axis of rotation, said first and second replacable cutting elements each comprising an L-shaped support member receivable in complementary-shaped slots in a radial annular face of said tool.

* * * * *